United States Patent [19]

Truman

[11] 3,931,959

[45] Jan. 13, 1976

[54] GUN FOR APPLYING REFRACTORY MATERIAL

[75] Inventor: George H. Truman, South Bend, Ind.

[73] Assignee: A. P. Green Refractories Co., Mexico, Mo.

[22] Filed: Oct. 29, 1974

[21] Appl. No.: 518,274

[52] U.S. Cl. ..... 259/151; 259/4 R

[51] Int. Cl.[2] ..... B28C 5/06

[58] Field of Search ..... 259/151, 147, 4, 18, 36, 259/146, 168, 169, 170, 161, 162

[56] References Cited

UNITED STATES PATENTS

| | | | |
|---|---|---|---|
| 1,848,122 | 3/1932 | Forster | 259/147 |
| 2,014,708 | 9/1935 | Vawter | 259/151 |
| 2,025,974 | 12/1935 | Fritz | 259/151 |
| 2,075,867 | 4/1937 | Sampel | 259/151 |
| 2,419,410 | 4/1947 | Maurer | 259/151 |

*Primary Examiner*—Robert W. Jenkins
*Attorney, Agent, or Firm*—Gravely, Lieder & Woodruff

[57] ABSTRACT

A gun for applying moistened refractory material to the interior surface of a furnace wall while the furnace is still heated includes an extended material tube or pipe long enough to reach into the furnace, and through this tube passes an airstream having dry granular refractory material entrained in it. Near its outer end the tube is encircled by a closure which defines an annular chamber to which water is supplied, and this chamber communicates with the interior of the tube through apertures arranged in at least one circumferential row so that the water in the chamber sprays into the tube and mixes with the refractory material. Beyond the closure the tube is fitted with a nozzle extension where thorough mixing of the water and refractory material occurs. A nozzle tip having an oval discharge opening is fitted onto the outer end of the nozzle extension and the moistened refractory material issues from the discharge opening. The tip may be straight or at an angle. In the latter case, abrasion is eliminated at the bend in the tip by providing a pocket on the backside of the bend to effect a build up of granular material at the change in direction.

12 Claims, 5 Drawing Figures

GUN FOR APPLYING REFRACTORY MATERIAL

BACKGROUND OF THE INVENTION

This invention relates in general to an apparatus for applying refractory material and more particularly to a gun capable of mixing dry refractory material with water and then discharging it with substantial force against a wall.

The heating and other operations carried on within furnaces lined with refractory material eventually erode or burn away portions of the refractory material. The refractory material requires replacement in order to restore the furnace to a useful condition. If the furnace is cooled to allow a repairman to enter the furnace safely, valuable production time is lost.

One method of repairing refractory linings of furnaces, boilers, and the like, without cooling the equipment and thereby losing substantial production time, is to pneumatically apply granular refractory mixtures to the hot furnace walls by means of a cement gun. The granular refractory mixture is blown by compressed air from a supply apparatus through hoses to a gun which is held by the operator such that the tip of its discharge nozzle is about 18 inches to 24 inches from the deteriorated lining which is to be repaired. Water is injected into the refractory mixture before it enters the discharge nozzle to enhance the bonding or "sticking" qualities of the mixture and to cause cement in the mixture to set.

Some furnaces are too large for the operator to bring the discharge nozzle to the prescribed distance from the lining for gunning and in such instances a pipe extension of the desired length is commonly inserted in the gun between the point of water injection, and the discharge nozzle. These extensions cause a loss of velocity and when the gun is inserted into a hot furnace, the pipe extension is heated, thus causing the moistened refractory material to stick to the inside of the pipe, clogging the same. To alleviate this problem, various devices have been tried which move the point of water injection or ring away from the operator and closer to the nozzle.

U.S. Pat. No. 2,419,410 shows a nozzle extension that is cooled by a water spray from holes in a pipe running parallel to the extension. A water ring also is used to wet the refractory material before it enters the nozzle.

To wet the refractory material, it has been a common practice to inject water into the material supply pipe within the gun before the material reaches the discharge nozzle. Devices heretofore developed for water injection cause uneven and ineffective distribution of the moisture through the material. This in turn results in a poor bond with the existing lining, and the newly applied refractory material tends to "rebound" from the existing lining. The material must be thoroughly wetted to achieve low rebound losses.

SUMMARY OF THE INVENTION

An object of this invention is to provide a gun for applying refractory materials to the linings of furnaces and other heated enclosures while such enclosures are at elevated temperatures. A further object is to provide a gun of the type stated which adequately and uniformly wets the dry refractory or other granular material as it passes through the gun and prior to being discharged into a hot furnace lining. Another object of this invention is to provide a gun with a wetting chamber that thoroughly and adequately wets the refractory or other granular material, which in combination with a tubular extension or nozzle of a specified length, prevents the premature drying and clogging of the refractory material in the gun. An additional object of this invention is to provide a gun with a discharge nozzle that causes the thorough mixing of the refractory material within the nozzle and causes a spray effect of the material issuing from the nozzle. Still another object of this invention is to provide a method of applying refractory or other granular material to the walls of hot furnaces so that the refractory or granular material does not "rebound" or slump away from the wall upon standing. These and other objects will become apparent hereinafter.

The present invention is embodied in a gun including a tube, a closure surrounding the tube and in communication with the interior of the tube so that water from the closure will enter the tube and mix with refractory material entrained in an airstream passing through the tube. The water and refractory material thoroughly mix in a nozzle extension on the tube, and the moistened refractory material issues from a non-circular discharge opening in a nozzle tip. The invention also resides in an angled tip having a pocket therein at the change in direction so that refractory material will accumulate in the pocket and prevent the high velocity refractory material from impinging against the nozzle tip itself. The invention also consists in the parts and arrangements and combinations of parts hereinafter described and claimed.

DESCRIPTION OF THE DRAWINGS

In the accompanying drawings, which form part of the specification and wherein like numerals refer to like parts wherever they occur.

DETAILED DESCRIPTION

Figures 1, 2, 3, 4, 5:
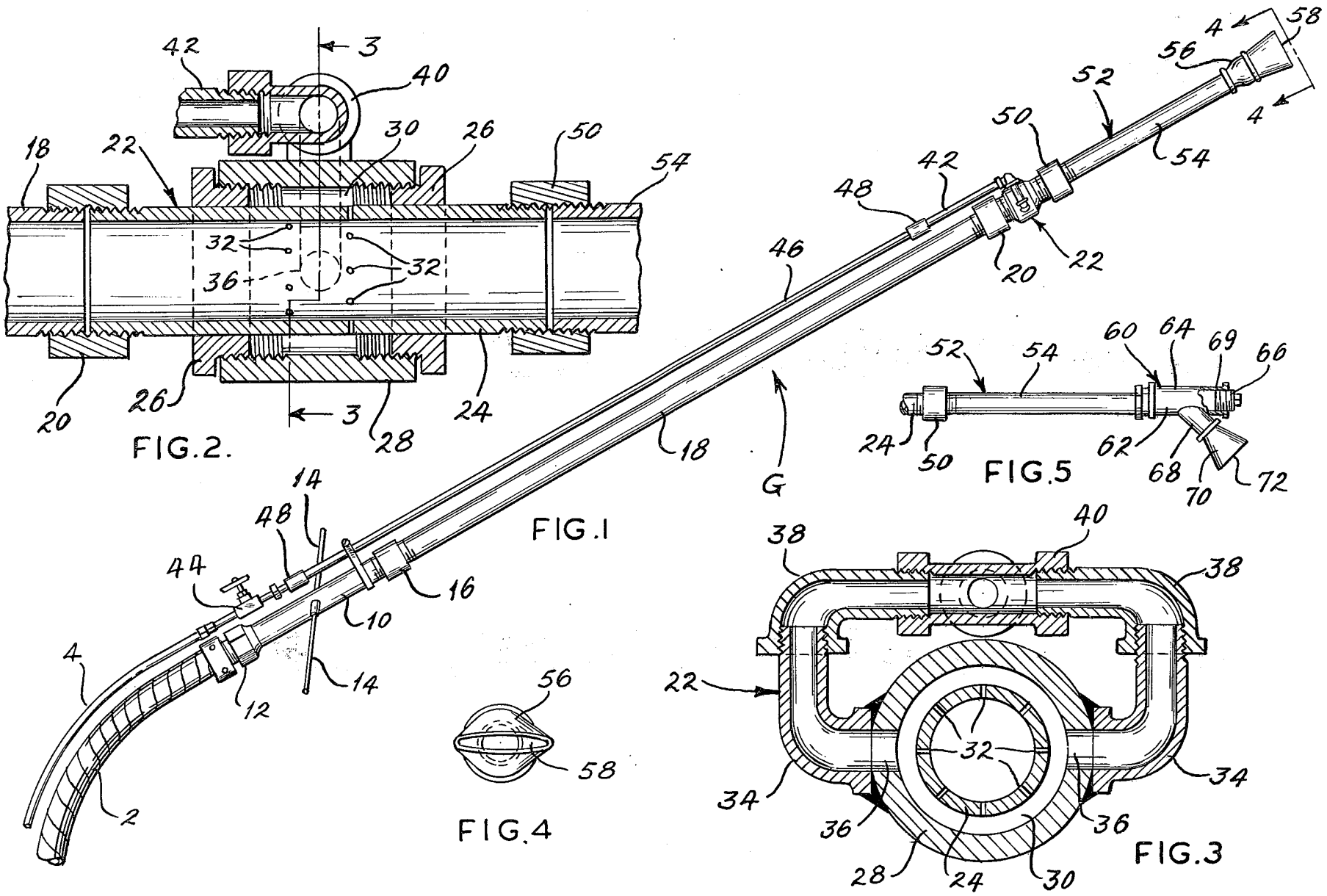
FIG. 1 is a side elevational view of a gun constructed in accordance with and embodying the present invention.
FIG. 2 is a cross sectional view of the wetting chamber taken at lines 2—2 of FIG. 1.
FIG. 3 is a vertical sectional view taken at lines 3—3 of FIG. 2.
FIG. 4 is a front elevational view of the discharge opening of the nozzle.
FIG. 5 is an elevational view of a modified nozzle.

Referring now to the drawings (FIG. 1), G designates a gun for applying refractory material to an interior wall surface of a furnace while the furnace is still heated. Consequently, it is not necessary to shut down the furnace in order to make repairs. The gun G is quite narrow so that it can be inserted into the furnace, and further is of extended length so that it can be manipulated from outside the furnace. The gun G at its one end is connected to a material hose 2 and also to a water hose 4. The material hose 2 in turn is connected to a source of compressed air and a source of granular refractory material with the arrangement being such that the granular refractory material is entrained in an airstream created in the hose 2 by the compressed air. This is conventional and, therefore, not illustrated. The water hose 4 is, of course, connected to a source of water with the water pressure (gauge) at the source being at least twice the pressure (gauge) of that being used to transfer the material through the gun G. This is recorded on a gauge of gun controls.

The gun includes (FIG. 1) a supply pipe 10 which is connected at its one end to the end of the material hose 2 by means of a coupling 12 on the hose 2. The pipe 10 is preferably 12 inches long and 1¼ inches inside diameter. Intermediate its ends, the pipe 10 has a pair of handles 14 projecting radially from it. The other end of the supply pipe 10 is connected by a pipe coupling 16 a pipe extension 18 which possesses the same inside diameter as the supply pipe 10. The length of the pipe extension 18 is dependent on the size of the furnace and should be such that the gun G can be brought close enough to any inside surface of the furnace to apply the refractory material. The far end of the pipe extension 18 is connected by means of another pipe coupling 20 to a water injection or wetting unit 22 for introducing water into the granular material as that material passes through the unit 22.

The wetting unit 22 includes (FIGS. 2 and 3) a short pipe 24 which is threaded at both ends and is about 6 inches long. The inside diameter of the pipe 24 equals that of the supply pipe 10 and the pipe extension 18. One end of the short pipe 24 threads into the pipe coupling 20 at the end of the pipe extension 18. Surrounding the cylindrical surface of the pipe 24 inwardly from the threads thereon are spaced apart bushings 26 (FIG. 2) which are threaded into a sleeve 28 surrounding the midportion of the pipe 24, but located radially outwardly therefrom. The bushings 26 are welded to the external surface of the pipe 24. Thus, the bushing 26 and the sleeve 28 define a closed annular chamber 30 around the midportion of the pipe 24. The chamber 30 communicates with the interior of the pipe 24 through holes 32 which are arranged in two circumferential rows. Each row contains the same number of holes 32 and these holes 32 are equally spaced in the circumferential direction. However, the holes 32 in one row are offset or staggered with respect to the holes 32 in the other row, with the angle of the offset being equal to one-half the angle between any two adjacent holes 32 in either row. Welded against the exterior surface of the sleeve 28 are two elbows 34 (FIG. 3) and the interiors of these elbows open into the annular chamber 30 through apertures 36 located 180° apart. The elbows 34 are connected to additional elbows 38 which are directed toward each other and these additional elbows 38 are threaded into the lateral extensions of a tee fitting 40.

The tee fitting 40 is located directly outwardly from the sleeve 28 and its third or intermediate leg is connected with a feed pipe 42 which extends over the pipe extension 18 for a short distance.

Water from the water hose 4 is directed to the feed pipe 42 through a needle valve 44 located adjacent the supply pipe 10 and a pipe extension 46 is located adjacent to the pipe extension 18 for the granular refractory material. The pipe extension 46 is connected to the feed pipe 42 and the valve 44 by couplings 48. Both the feed pipe 42 and the pipe extension 46 are preferably ½ inches inside diameter.

Connected to the outer end of the short pipe 24 on the wetting unit 22 by means of another coupling 50 is a nozzle 52 (FIG. 1) which includes a nozzle extension pipe 54 and a nozzle tip 56. The nozzle extension 54 has the same inside diameter, as the short pipe 24 of the wetting unit 22, that is 1¼ inches, and is preferably 18 inches in length. The tip 56 threads over the outer end of the extension pipe 54 and at its greatest inside diameter is slightly larger than the inside diameter of the pipe 54. Preferably, the greatest inside diameter of the tip 56 is 1½ inches. The tip 56 has an oval or elongated discharge opening 58 (FIG. 4), which is smaller in cross-sectional area than the nozzle extension pipe 54 and has a minimum dimension of about ¾ inch. Actually, the end of the tip 56 may be a short 1½ inch pipe nipple deformed at its one end into an oval configuration having a ¾ inch minimum dimension. The length of the nozzle extension pipe 54 should be such that the distance between the last or downstream row of holes 32 in the wetting unit 22 and the discharge opening 58 is between 26 and 28 inches and preferably 27 inches.

OPERATION

In use the gun G is inserted into a furnace, which may be heated at the time, but is manipulated from outside the furnace by the operator who grasps the gun G at the supply pipe 10 and handles 14. The operator holds the gun G such that the nozzle tip 56 is 18 to 24 inches from the deteriorated surface of the furnace wall and the moistened refractory material issues from the nozzle 52 in a fan shaped pattern. This material discharges with sufficient force to reach the damaged wall surface and adhere thereto. The material sets up quite rapidly in the heated atmosphere of the furnace and repairs the damage.

More specifically, an airstream having the dry granular refractory material entrained in it passes through the material hose 2 as well as through the supply pipe 10, the pipe extension 18, and also the short pipe 24 in the wetting unit 22, all of which constitutes a continuous tube. Water is introduced into this airstream at the wetting unit 22 to give the refractory material adhesive or sticking properties, and to further enable it to set up in the heated atmosphere of a furnace.

The water comes from the water hose 4, and thereafter passes through the valve 44, the pipe extension 46 and the feed pipe 42. After flowing through the elbows 38 and 34 of the wetting unit 22, the water flows into the annular chamber 30 within that unit. Being under pressure, the water in the chamber 30 discharges into the interior of the pipe 24 through the holes 32 with considerable velocity causing a mixing of the water with the refractory material.

The moistened refractory material thereafter flows through the nozzle 52 and is discharged from the oval discharge opening 58 thereof. The nozzle extension pipe 54 is short enough to prevent caking of the refractory material in it. In this regard, it should be noted that in some guns for applying refractory material, the distance between the nozzle tip and the point of water injection is so great, that when the gun is exposed to the elevated temperatures of a furnace, the pipe heats up and causes the moistened refractory material to set up against the walls of the pipe and eventually clog the pipe. This does not occur in the gun G because the wetting unit 22 is located far enough downstream and the nozzle extension is short enough to avoid having the moistened refractory material exposed to a heated surface for excessive time.

The oval discharge opening 58 directs the moistened refractory material into a fan-shaped pattern as it issues from the nozzle 52. This pattern is most suitable for coating furnace walls. The oval opening 58 further causes a change in the shape of the flow and this creates a back pressure within the nozzle extension 54. The change in the shape of the flow also aids in mixing the water and the refractory material. The end result is a thorough mixing of the water and refractory material.

Thus, the length of the nozzle extension pipe 54 is indeed critical. It is long enough to afford thorough mixing of the water and refractory material, yet is short enough to prevent excessive heating of the moistened refractory material so that caking within the pipe 54 does not occur. The distance from the last row of apertures or holes 32 to the oval discharge opening 58, which is the critical distance, should be between 26 inches and 28 inches, and preferably 27 inches.

The flow of water is adjusted at the needle valve 44 until the moistened refractory material issuing from the nozzle 52 possesses the desired consistency. Best results are obtained when the water pressure beyond the valve 44, that is, in the chamber 30 of the wetting unit 22, exceeds the pressure of the airstream within the short pipe 24 of the wetting unit 22 by at least twice the pressure as that of air-material mixture recorded at the gun controls.

MODIFICATION

In lieu of the straight nozzle tip 56, the nozzle 52 may have an angle tip 60 which is more suitable for repairing sidewalls and other surface areas which cannot be easily reached by the straight tip 56. The angle tip 60 includes a Y-fitting 62 having a straight section 64, the inside diameter of which is slightly greater than the inside diameter of the extension pipe 54, and is preferably 1½ inches. One end of the straight section 64 is connected to the outer end of the extension pipe 54, while the opposite end is closed with a plug 66. Intermediate the two ends of the straight sections 64, a lateral branch 68 projects from the straight section at a 45° angle. The lateral branch 68 is likewise equal in inside diameter to the inside diameter of the straight section 64. The plug 66 does not extend all the way to the lateral branch 68 so that a pocket 69 exists within the straight section 64 immediately beyond the lateral branch 68. Attached to the lateral branch 68 is a mouth portion 70 having an oval discharge opening 72 which is the same shape as the discharge opening 58 of the nozzle tip 56.

The nozzle tip 60 functions quite similar to the nozzle tip 56, only the fan shaped spray of refractory material is discharged somewhat laterally, that is, at an angle of 45° with respect to the axis of the gun G, instead of directly along that axis. Abrasion at the turn within the angle tip 60 is practically eliminated since refractory material builds up in and fills the pocket 69 so that subsequent refractory material merely impinges against that already in the pocket 69.

This invention is intended to cover all changes and modifications of the example of the invention herein chosen for purposes of the disclosure which do not constitute departures from the spirit and scope of the invention.

What is claimed is:

1. A gun for applying a refractory material to a surface, said gun comprising: a rigid tube into which an airstream having dry granular refractory material entrained in it is introduced so that the airstream flows through the tube, the tube having apertures therein arranged in at least one circumferential row; a closure on the tube and defining an annular chamber surrounding the tube at the apertures in the tube so that the chamber communicates with the interior of the tube through the apertures; means connected to a source of water and to the closure for directing water to the chamber, whereby the water will flow into the interior of the tube and mix with the refractory material entrained in the airstream; a straight nozzle extension extended beyond the closure on the tube so that the airstream containing the moistened refractory material passes into the material; extension where the water further mixes with the refractory material; and a nozzle tip on the nozzle extension, the nozzle tip having a discharge opening of non-circular cross-section so as to change the shape of the flow and effect a back pressure in the nozzle extension the nozzle tip containing a passage which communicates with the interior of the nozzle extension and has a turn therein so as to change the direction of the moistened refractory material passing through the nozzle tip, the nozzle tip further having a pocket along the backside of the turn therein so that some refractory material will accumulate in the pocket, whereby the refractory material will not impinge against and wear out the nozzle tip at the turn.

2. A gun according to claim 1 wherein the apertures in the tube are arranged in two axially spaced circumferential rows.

3. A gun according to claim 2 wherein the apertures in the two rows are equally spaced and the apertures in the one row are offset in the circumferential direction with respect to the apertures in the other row.

4. A gun according to claim 1 wherein the distance from the apertures to the discharge opening in the nozzle tip between 26 and 28 inches.

5. A gun according to claim 1 wherein the discharge opening in the nozzle tip is oval shaped.

6. In a gun for applying refractory material to a surface and including a rigid tube into which an airstream having dry granular refractory material entrained in it is introduced so that the airstream flows through the tube, and wetting means carried by the tube for introducing water into the airstream so that the water will mix with the refractory material, the improvement comprising a nozzle in communication with the tube beyond the wetting means, the nozzle including a tip provided with an interior passage connected with the interior of the tube and having a turn therein so that the airstream changes direction as it passes through the nozzle tip, the nozzle tip further having a pocket along the backside of the turn so that some refractory material will accumulate in the pocket, whereby the refractory material will not impinge against and wear out the nozzle tip at the turn.

7. The structure according to claim 6 wherein the nozzle tip contains a removable plug located beyond the change in direction and at the end of the pocket.

8. The structure according to claim 6 wherein the nozzle tip includes a straight section at which the airstream enters the tip, and a lateral branch disposed at an oblique angle with respect to the straight section and connected to the straight section intermediate its ends so that a portion of the straight section exists ahead of and beyond the lateral branch, the portion beyond the lateral branch forming the pocket in which the refractory material accumulates.

9. The structure according to claim 8 wherein the nozzle tip further comprises a plug threaded into the portion of the straight section located beyond the lateral branch to close the end of the pocket.

10. The structure according to claim 8 wherein the nozzle further comprises a mouth portion connected to the lateral branch and having a discharge opening of noncircular cross-section.

11. The structure according to claim 10 wherein the nozzle further comprises: a straight nozzle extension interposed between the tube and the straight section of the nozzle tip, the cross-sectional area of the interior of the nozzle extension being greater than the cross-sectional area of the discharge opening in the nozzle mouth.

12. A gun for applying a refractory material to a surface exposed to a high temperature environment, said gun comprising: an extended pipe having a gripping portion at one end and being connected at said one end with an airstream having dry granular refractory material entrained in it so that the airstream passes into and through the pipe; a wetting unit connected to the opposite end of the pipe and including a short pipe which forms a continuation of the extended pipe so that the airstream passes into the short pipe, the wetting unit having a closure encircling the short pipe and defining an annular chamber which surrounds the short pipe, the short pipe having apertures therein which provide communication between the annular cavity surrounding the short pipe and the interior of the short pipe, the apertures being arranged in two circumferential rows with the apertures in the one row being offset in the circumferential direction with respect to the apertures in the other row; a water pipe located adjacent and parallel to the extended pipe and being connected between a source of high pressure water and the annular cavity of the wetting unit so that water will flow into the annular cavity and thence into the short pipe through the apertures therein and will mix with the granular material in the airstream flowing through the short pipe to wet the granular material; a manually operated needle valve in the water pipe for controlling the flow of water through it, the needle valve being located adjacent to the gripping portion of the extended pipe; a nozzle extension pipe connected to the wetting unit and forming a continuation of the short pipe thereof so that the airstream passes into the nozzle extension pipe along with the water introduced at the wetting unit, whereby the water will continue to mix with granular material in the extension pipe; and a rigid nozzle tip of fixed shape on the nozzle extension pipe, the nozzle tip having a discharge end of oval cross section which is smaller in area than the cross-sectional area of the nozzle extension pipe so as to change the shape of the flow and effect a back pressure in the nozzle extension pipe.

* * * * *

UNITED STATES PATENT OFFICE

CERTIFICATE OF CORRECTION

Patent No. 3,931,959 Dated January 13, 1976

Inventor(s) George H. Truman

It is certified that error appears in the above-identified patent and that said Letters Patent are hereby corrected as shown below:

Column 6, line 7, after "the" and before the word "extension", please cancel "material;" and insert "nozzle"

Signed and Sealed this sixth Day of April 1976

[SEAL]

*Attest:*

RUTH C. MASON
*Attesting Officer*

C. MARSHALL DANN
*Commissioner of Patents and Trademarks*